United States Patent [19]

Shimizu et al.

[11] Patent Number: 4,479,106

[45] Date of Patent: Oct. 23, 1984

[54] ROTARY ELECTRIC COMPONENT

[75] Inventors: Yutaka Shimizu; Junichi Imura; Shoichi Henmi, all of Miyagi, Japan

[73] Assignee: Alps Electric Co., Ltd., Tokyo, Japan

[21] Appl. No.: 430,600

[22] Filed: Sep. 30, 1982

[30] Foreign Application Priority Data

Feb. 12, 1982 [JP] Japan ..... 57-19129[U]
Feb. 12, 1982 [JP] Japan ..... 57-19130[U]

[51] Int. Cl.[3] ..... H01C 10/30

[52] U.S. Cl. ..... 338/160; 338/174; 338/164; 338/199

[58] Field of Search ..... 338/160–164, 338/174, 175, 184, 188, 199

[56] References Cited

U.S. PATENT DOCUMENTS 2,811,621 10/1957 Mucher et al. ..... 338/174 X
4,109,230 8/1978 Frey, Jr. ..... 338/199 X

*Primary Examiner*—C. L. Albritton

*Attorney, Agent, or Firm*—Guy W. Shoup; Gerard F. Dunne

[57] ABSTRACT

A rotary electric component such as a semifixed variable resistor comprises an insulating substrate having a shaft hole and a slot communicating with the shaft hole, a resistor mounted on the insulating substrate surrounding the shaft hole, a pair of electrodes mounted on the insulating substrate and connected to the resistor at ends thereof, the electrodes being positioned one on each side of the slot and prevented by the latter from short-circuiting therebetween, a pair of terminals mounted on the insulating substrate and connected to the electrodes, respectively, a shaft rotatably mounted in the shaft hole and having a movable contact held in sliding contact with the resistor, and a body of synthetic resin filled in the slot. The body of synthetic resin is fixedly mounted on the insulating substrate and may include a support spacer disposed around the shaft hole and a protective cover covering attachment end portions of the terminals.

5 Claims, 10 Drawing Figures

ROTARY ELECTRIC COMPONENT

BACKGROUND OF THE INVENTION

The present invention relates to a rotary electric component such as a semifixed variable resistor or a rotary switch.

Known semifixed variable resistors often are fabricated of a relatively large number of parts, assembled in a tedious and time-consuming operation having many assembling steps, and have an insulating substrate which is relatively large in size. Also, the prior insulating substrate may be mechanically weak because of a central slot often provided therein for preventing shortcircuiting between terminals mounted on the insulating substrate.

SUMMARY OF THE INVENTION

Therefore, it is an object of the present invention to provide an insulating substrate for use in rotary electric components which will eliminate the conventional difficulties of preventing shortcircuiting between the electrodes and inscreasing the mechanical strength of the portions of the insulating substrate on which the terminals are installed.

Another object of the present invention is to provide a rotary electric component which is made from a reduced number of parts, can be assembled in a simplified operation, and has a small-sized insulating substrate.

According to the present invention, a rotary electric component such as a semifixed variable resistor comprises an insulating substrate having a shaft hole and a slot communicating with the shaft hole, a resistor mounted on the insulating substrate surrounding the shaft hole, a pair of electrodes mounted on the insulating substrate and connected to the resistor at ends thereof, the electrodes being positioned one on each side of the slot and prevented by the latter from shortcircuiting therebetween, a pair of terminals mounted on the insulating substrate and connected to the electrodes, respectively, a shaft rotatably mounted in the shaft hole and having a movable contact held in sliding contact with the resistor, and a body of synthetic resin filled in the slot. The body of synthetic resin is fixedly mounted on the insulating substrate and may include a support spacer disposed around the shaft hole and a protective cover covering attachment end portions of the terminals.

The above and other objects, features and advantages of the present invention will become more apparent from the following description when taken in conjunction with the accompanying drawings in which preferred embodiments of the present invention are shown by way of illustrative example.

Figure 3A:
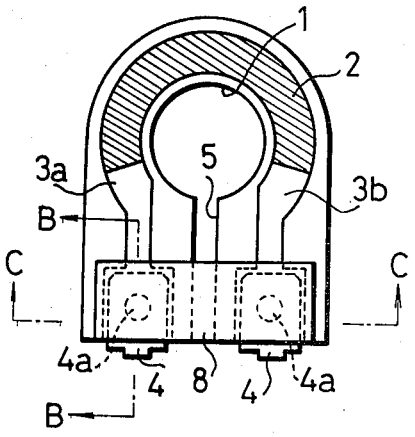
Figure 3B:
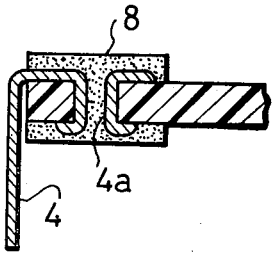
Figure 3C:
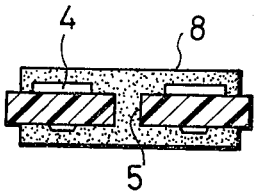
Figure 4A:
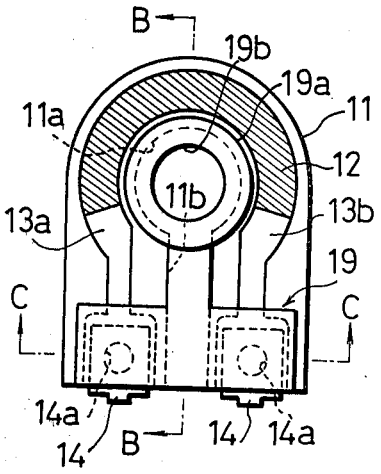
Figure 4B:
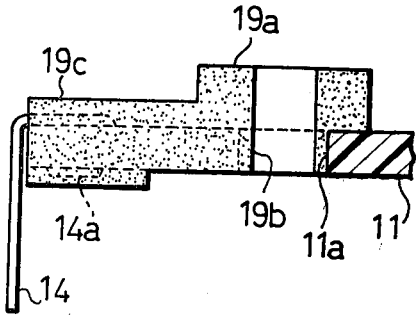
Figure 4C:
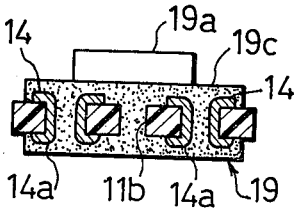

FIG . 3(A) is a front elevational view of an insulating substrate in a semifixed variable resistor according to an embodiment of the present invention;

FIG. 3(B) is an enlarged cross-sectional view taken along line B—B of FIG. 3(A);

FIG. 3(C) is a cross-sectional view taken along line C—C of FIG. 3(A);

FIG. 4(A) is a front elevational view of an insulating substrate in a semifixed variable resistor according to another embodiment of the present invention;

FIG. 4(B) is an enlarged cross-sectional view taken along line B—B of FIG. 4(A);

FIG. 4(C) is a cross-sectional view taken along line C—C of FIG. 4(A); and

Figure 5:
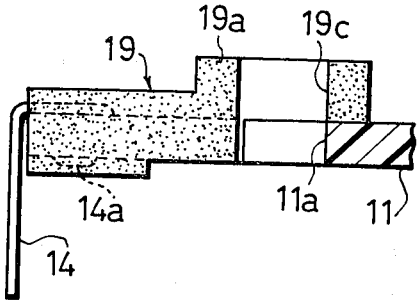

FIG. 5 is a view similar to FIG. 4(B), showing still another embodiment of the present invention.

DETAILED DESCRIPTION

Figure 1A:
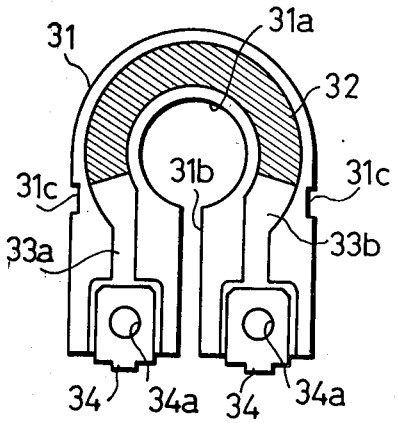
Fig.1(A) PRIOR ART
FIG. 1(A) is a front elevational view of an insulating substrate in a conventional semifixed variable resistor.
Figure 1B:
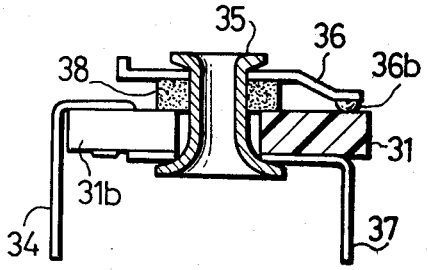
Fig.1(B) PRIOR ART
FIG. 1(B) is a longitudinal cross-sectional view of a conventional semifixed variable resistor.

FIGS. 1(A) and 1(B) show a conventional semifixed variable resistor. The semifixed variable resistor has an insulating substrate 31 typically made of a laminated sheet of phenolic resin or the like. The insulating substrate 31 has a central shaft hole 31*a* and a semicircular resistor 32 deposited on a surface thereof concentrically around the shaft hole 31*a*, the resistor 32 typically being carbon printed on the insulating substrate 31. The resistor 32 has on ends thereof a pair of electrodes 33*a*, 33*b* of silver or the like deposited on the insulating substrate 31 by printing or evaporation. A pair of terminals 34 are fixed respectively to ends of the electrodes 33*a*, 33*b* by grommets 34*a* staked around attachment holes defined in the insulating substrate 31. The insulating substrate 31 has a slot 31*b* formed centrally between the electrodes 33*a*, 33*b* and extending contiguously to the shaft hole 31*a*. The slot 31*b* serves to prevent migration of silver which would be caused when the electrodes 33*a*, 33*b* are to be deposited, thereby avoiding shortcircuiting between the electrodes 33*a*, 33*b*.

For assembling the semifixed variable resistor, a shaft 5 is rotatably mounted in the shaft hole 31*b*, as shown in FIG. 1(B). Then, a movable contact 36 is attached to an upper portion of the shaft 35, and a terminal 37 is attached to the reverse side of the insulating substrate 31 in electric connection to the shaft 35. A support spacer 38 of synthetic resin is fitted around the shaft 35 between the movable contact 36 and the insulating substrate 31 for supporting the shaft 35 in position. When the shaft 35 and the movable contact 36 are rotated, a distal end of the movable contact 36 is caused to slide on the resistor 32 to vary the resistance between the terminals 37, 34.

The prior semifixed variable resistor is made up of an increased number of parts and will be assembled in a number of steps as the support spacer 38 and the insulating substrate 31 are separately formed. Since the support spacer 38 rotates with the shaft 35 and the movable contact 36, it is necessary that the terminals 34 be spaced from the support spacer 38. Accordingly, the insulating substrate 31 is relatively large in size, a limitation which obstacles miniaturization of the semifixed variable resistor. The known semifixed variable resistor is also disadvantageous in that the slot 31*b* reduces the mechanical strength of the insulating substrate 31, which is liable to get damaged under external forces.

Figure 2:
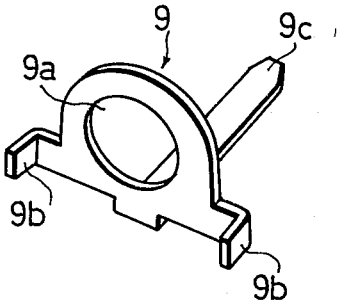
Fig.2 PRIOR ART
FIG. 2 is a perspective view of a conventional reinforcing collector.

To prevent such damage to the insulating substrate 31, it has been customary to employ a collector 9 as shown in FIG. 2. The collector 9 is shaped by pressing a sheet of metal, and has a central shaft hole 9*a*, a pair of lateral grip fingers 9*b* and a lower attachment arm 9*c* bent rearward. During assembly of the semifixed variable resistor, the collector 9 is attached to a back of the insulating substrate 31, and then the grip fingers 9*b* are bent in and over respective grooves 31*c* defined in opposite edges of the insulating substrate 31. The grip fingers 9b thus mounted serve to prevent the end portions of the insulating substrate 31 on which the terminals 34 are mounted from spreading laterally away from each other.

The present invention will now be described.

FIGS. 3(A) through 3(C) are illustrative of an insulating substrate constructed in accordance with an embodiment of the present invention. The insulating substrate has a shaft hole 1 and a semicircular resistor 2 printed on its surface in concentrical relation to the shaft hole 1. The insulating substrate also has a pair of electrodes 3a, 3b of silver printed or evaporated thereon and connected to ends of the resistor 2. A pair of terminals 4 are fixed to ends of the electrodes 3a, 3b, respectively, by staked grommets 4a. The insulating substrate also has a slot 5 located between the electrodes 3a, 3b and communicating with the shaft hole 1, the slot 5 serving to prevent migration of the silver material of the electrodes 3a, 3b.

According to the present invention, the insulating substrate has on its end a molded body 8 formed of a synthetic resin different from the material of the insulating substrate and molded thereon by outsert molding. The molded body 8 fills in both a lower portion of the slot 5 and the grommets 4a, and covers the front and back of lower end portions of the insulating substrate, with the terminals 4 being completely embedded in the molded body 8.

When a semifixed variable resistor is to be assembled using the above insulating substrate, a rotor having a slidable contact is first installed on the surface of the insulating substrate, so that the rotor can rotate about the shaft hole 1 with the slidable contact being slidable on the resistor 2 in response to rotation of the rotor. Thus, the resistance between a terminal leading to the slidable contact and either one of the terminals 4 can be varied upon rotation of the rotor.

The molded body 8 serves to make up for a reduction in the mechanical strength of the insulating substrate due to the presence of the slot 5, and hence renders the collector 9 as shown in FIG. 2 unnecessary. The insulating substrate has no groove such as the grooves 31c as shown in FIG. 1(A) needed for the attachment of the collector 9.

While in the illustrated embodiment the insulating substrate has been shown as being incorporated in a semifixed variable resistor, the present invention is also applicable to insulating substrates for use in other electric components such as a slide-wire rheostat and a switch, and ordinary insulating substrates having a plurality of electrodes.

With the arrangement of the foregoing embodiment, a synthetic resin material fills portions of a slot defined in an insulating substrate between electrodes and interconnects the opposite edges of the slot to compensate for a reduction in the mechanical strength of the insulating substrate due to the slot. Thus, the electrodes can reliably be prevented from being subjected to shortcircuiting which would otherwise be caused by the slot, and the insulating substrate has no risk of getting damaged under external forces applied. The present invention is particularly useful when embodied in a small-sized insulating substrate on which electrodes are disposed highly close together since no reduction in the mechanical strength is caused and shortcircuiting between the electrodes can effectively be prevented. With a collector such as shown at 9 in FIG. 2 being dispensed with, the number of parts is reduced and the parts used can be smaller in size. The synthetic resin can easily and reliably be filled in the slot by outsert molding. Accordingly, the present invention can be applied to insulating substrates of any shape which are assembled in flow operation. The terminals as covered with the molded synthetic resin have an increased strength of attachment.

FIGS. 4(A) through 4(C) show an insulating substrate according to another embodiment of the present invention. The insulating substrate, designated by the reference character 11, is in the form of a laminated sheet of phenolic resin, and has a shape substantially as shown in FIG. 1(A). More specifically, the insulating substrate 11 has a central shaft hole 11a and a slot 11b extending contiguously to the central shaft hole 11a and serving to prevent shortcircuiting between electrodes 13a, 13b. A resistor 12 of carbon is deposited on the insulating substrate 11. The electrodes 13a, 13b are made of silver and deposited on the insulating substance 11 and connected respectively to ends of the resistor 12. Terminals 14 are fixed by grommets 14a, 14b and connected respectively to ends of the electrodes 13a, 13b.

A molded body 19 is molded on the insulating substrate 11 by way of outsert molding, the molded body 19 being formed of a synthetic resin material different from that of the insulating substrate 11. A portion of the molded body 19 is formed as an annular support spacer 19a extending around the shaft hole 11a and having a lower portion held in intimate contact with an inner peripheral edge of the shaft hole 11a in the insulating substrate 11. The support spacer 19a has a central support hole 19b coaxial with the shaft hole 11a. The molded body 19 has another portion extending as a protective cover 19c over the terminals 14. As shown in FIG. 4(C), the protective cover 19c extends through the grommets 14a to the reverse side of the insulating substrate 11, thereby fully covering attachment end portions of the terminals 14. The molded body 19 fills in the slot 11b which is defined in the insulating substrate 11 to prevent shortcircuiting between the electrodes 13a, 13b. The end portions of the insulating substrate 11 on both sides of the slot 11b are retained and reinforced by the molded body 19.

In assembly of a semifixed variable resistor using the insulating substrate 11, a rotatable shaft similar to the rotatable shaft 35 shown in FIG. 1(B) is inserted into the support hole 19b in the support spacer 19a. A movable contact is fixed to an upper end of the rotatable shaft and a terminal is attached to the reverse side of the insulating substrate 11 in electrical contact with the shaft. Since the insulating substrate 11 is reinforced at the slot 11b by the molded by 19, no collector as shown in FIG. (A) is necessary which would otherwise be attached to the insulating substrate to hold the same.

Operation of the semifixed variable resistor thus constructed is as follows: When the shaft is rotated about its own axis by the tip of a screwdriver, the distal end of the movable contact is caused to slide on the resistor 12. When the movable contact is stopped at a desired position, a resistance is established between either one of the terminals 14 and the terminal connected to the movable shaft.

FIG. 5 shows an insulating substrate according to still another embodiment. As shown, a support spacer 19a constituted by a portion of a molded body has a support hole 19c coextensive with the shaft hole 11a in the insulating substrate 11 with no synthetic resin material disposed in the shaft hole 11*a*.

While in the illustrated embodiment a semifixed variable resistor has been described as being a rotary electric component to which the present invention is applicable, the present invention can also be applied to a rotary switch, for example.

With the foregoing embodiments shown in FIGS. 4(A)–4(C) and 5, a molded body has a portion serving as a support spacer, and hence a device made of a reduced number of parts and can be assembled in a simplified operation as compared with conventional devices having separate support spacers. The molded body has another portion serving to cover attachment end portions of terminals, with the results that the strength with which terminals are attached is increased, and the terminal attachment end portions are prevented from contacting terminals on other components or lead wires. With a protective cover covering the terminal attachment end portions and the support spacer being integrally molded of synthetic resin, grommets on the terminal attachment end portions may be located closely to a movable shaft without the danger of shortcircuiting or obstructing rotation of the shaft. Therefore, the insulating substrate can be as small as possible, and the other parts can be smaller in size. The protective cover and the support spacer can be integrally molded of the same synthetic resin material on the insulating substrate in a single operation of outsert molding. The insulating substrate of the invention can consequently be mass-produced.

Although certain preferred embodiments have been shown and described, it should be understood that many changes and modifications may be made therein without departing from the scope of the appended claims.

What is claimed is:

1. A rotary electric component comprising:

(a) an insulating substrate having a hole adapted to receive a rotary shaft, and a slot communicating with said hole;

(b) a resistor mounted on said insulating substrate concentrically with said hole;

(c) a pair of electrodes mounted on said insulating substrate and connected to said resistor at respective ends thereof, said electrodes being positioned on respective sides of said slot and prevented by the latter from shortcircuiting therebetween;

(d) a pair of terminals mounted on said insulating substrate and connected to said electrodes, respectively;

(e) a shaft rotatably mounted in said hole and having a movable contact held in sliding contact with said resistor; and (f) a body of synthetic resin filling portions of said slot.

2. A rotary electric component comprising:

(a) an insulating substrate having a hole adapted to receive a rotary shaft;

(b) a resistor mounted on said insulating substrate concentrically with said hole;

(c) a pair of electrodes mounted on said insulating substrate and connected to said resistor at respective ends thereof;

(d) a pair of terminals mounted on said insulating substrate and connected to said electrodes, respectively, said terminals having attachment end portions fixed to said insulating substrate;

(e) a shaft rotatably mounted in said hole and having a movable contact held in sliding contact with said resistor; and (f) means including a body of synthetic resin molded onto said insulating substrate for providing a support spacer disposed around said hole and a protective cover covering said attachment end portions.

3. A rotary electric component according to claim 2, wherein said insulating substrate has a slot defined therein between said electrodes, said body of synthetic resin having a portion filled in said slot.

4. A rotary electric component according to claim 1, said body of synthetic resin being of a material different from that forming said substrate.

5. A rotary electric component according to claim 2, said body of synthetic resin being of a material different from that forming said substrate.

* * * * *